United States Patent [19]

Moser et al.

[11] 4,185,745

[45] Jan. 29, 1980

[54] SHEET PACKAGING ARRANGEMENT

[75] Inventors: Kurt Moser, Gerlingen; Heinrich Kaufmann, Stuttgart, both of Fed. Rep. of Germany

[73] Assignee: Fa. Develop KG, Dr. Eisbein and Co., Fed. Rep. of Germany

[21] Appl. No.: 784,378

[22] Filed: Apr. 4, 1977

[30] Foreign Application Priority Data

Apr. 3, 1976 [DE] Fed. Rep. of Germany ..... 2614530

[51] Int. Cl.[2] ..... B65D 5/72

[52] U.S. Cl. ..... 206/556; 206/555; 229/17 S

[58] Field of Search ..... 229/17 S; 291/145; 206/556, 565, 451, 554, 449, 555; 229/38

[56] References Cited

U.S. PATENT DOCUMENTS

| | | | |
|---|---|---|---|
| 1,695,432 | 12/1928 | Lovejoy | 206/449 |
| 2,638,211 | 5/1953 | Spurr | 206/449 |
| 3,186,542 | 6/1965 | Greene | 206/449 |
| 3,631,972 | 1/1972 | Gendron et al. | 206/449 |
| 3,642,273 | 2/1972 | Baglio | 206/449 |
| 3,647,076 | 3/1972 | Heimann | 206/449 |
| 3,727,823 | 4/1973 | Sullivan | 206/449 |
| 3,761,012 | 9/1973 | Rosenburg, Jr. | 206/449 |
| 3,765,531 | 10/1973 | Hardy, Sr. | 206/449 |
| 3,892,309 | 7/1975 | Coffey et al. | 206/449 |
| 4,085,884 | 4/1978 | Högenett et al. | 206/565 |

*Primary Examiner*—Joseph Man-Fu Moy
*Attorney, Agent, or Firm*—Craig and Antonelli

[57] ABSTRACT

A packaging arrangement for a stack of sheets which includes a container surrounding the stack on all sides and adapted to the contour of the stack of sheets. The container is provided with predetermined separating zones whereby, upon separation of the container along the predetermined separating zones, a portion of the container can be removed and the stack of sheets partially uncovered thereby permitting access of the stack of sheets to a further processing apparatus.

10 Claims, 7 Drawing Figures

SHEET PACKAGING ARRANGEMENT

The present invention relates to a packaging arrangement and, more particularly, to a packaging arrangement for packing a stack of sheets, especially coated paper sheets, which includes a container surrounding the stack of sheets on all sides.

Packaging means of the aforementioned type are useful, for example, in packaging copying materials for copying machines for the purposes of storage and transportation of the sheets. Customarily, stacks of copying material having a specific number of sheets are wrapped with a wrapping paper and, when the stack is to be utilized, the wrapping paper is completely removed and the stack is then inserted into a storage device which surrounds the stack so that the sheets are held in a predetermined position.

The aim underlying the present invention essentially resides in providing an improved packaging arrangement which is capable of performing an additional function. For this purpose, a container is provided which is closed on all sides and is adapted to conform to the contour of the stack of sheets with prepared predetermined separating zones being formed at the container which, upon destroying of such separating zones, permits a portion of the container to be removed so that the stack of sheets is partially uncovered.

By virtue of the constructional features of the present invention, it is possible to employ the packaging arrangement for the stack of sheets as a type of cassette which can be inserted into a device to which the sheets of the stack are fed for processing and which offers the individual sheets for further use.

One advantage of the packaging arrangement of the present invention resides in the fact that, by virtue of its construction, a machine or device for processing the sheets can be constructed with stack receiving means which are substantially simple and no effort nor provision need be made for holding the relatively stiff container of the present invention by complicated devices so that the sheets are in a proper position. In accordance with the present invention, the sheets are held in the container so that the stack remains preserved and intack while the sheets are nevertheless readily accessible for an appropriate take-off separating device.

In one advantageous embodiment of the present invention, the provision is made to form the container of a cut-to-size panel or piece of a relatively stiff material such as cardboard or paperboard with the panel or piece being provided with prepared separating or parting lines. From such a cut-to-size panel, a suitable container can be manufactured in a simple and economical fashion.

Preferably, the prepared separating or parting lines are fashioned as perforations so that there is no difficulty in destroying or breaking open the container along the predetermined parting lines and such breaking can be effected without the need of a special tool or the like. Advantageously, in accordance with the present invention, the parting lines divide an end wall and an adjoining strip of a top wall or cover of the container from the remaining portion thereof whereby provision is made for a simple take-off operation by way of a separating means or take-off reels.

According to another advantageous feature of the present invention, if the container is utilized, for example, in a copying machine, to directly effect a holding and aligning of the stack, preferably, the removable part of the container encompasses an end zone of the side walls adjoining a removable end wall and, on both sides in this zone, edge grips of the bottom wall of the container whereby, upon opening the container, the forward edge zone of the paper stack is uncovered so that it can be gripped by devices for aligning and/or separating fixedly attached to the processing machine.

According to yet a further advantageous feature of the present invention, the removable portion of the container includes tongues which are arranged in the bottom wall of the container and which are removed during an opening of the container such that cut-outs are provided in the bottom wall of the container whereby a suitable holding device or the like is provided with access to the underside of the sheets of the stacks so as to exert a clamping force directly on the stack thereby facilitating the separation of the sheets.

In accordance with a further advantageous feature of the present invention, the provision is made that at least one flap projects from at least one of a side wall and/or from an end wall of the container. The flap is arranged at the side wall and/or end wall of the container which is not removed with the flap projecting into the interior of the container and resting resiliently on the stack of sheets. By virtue of this arrangement, it is possible to prevent the individual sheets from curling or curving even if the container is almost completely empty whereby throughout the entire processing the sheets in the stack retain their desired position. Moreover, the provision of flaps has the advantage that it is impossible to withdraw a sheet from the container and then return the sheet to the stack of sheets in the container since the flaps form a barrier arrangement preventing reinsertion of the sheet. This latter feature is significant since an incorrect reinsertion of the sheets into the container could lead to certain operational difficulties in the processing machine. Specifically, if for example the packaging arrangement is used in a copying machine which employs coated sheets as the copying material and one or more such sheets were reinserted into the stack with the coated side of the sheet placed in the wrong direction, the copying machine would not properly function when processing the reinserted sheets.

In a further embodiment in accordance with the present invention, the container is closed by way of a fishplate provided on an end wall of the container with the fishplate being adapted to be inserted beneath an upper wall of the container. A predetermined separating line is provided along a bottom wall of the container adjacent the end wall so that, to open the container, the fishplate is pulled out from under the top wall of the container and separated along the predetermined separating line.

According to another features of the present invention, notches are provided in the side walls and bottom walls of the container so as to ensure a tearing off or separation of the end wall and fishplate along the predetermined separating line.

Accordingly, it is an object of the present invention to provide a packaging arrangement for stacks of sheets which avoids the shortcomings and drawbacks encountered in the prior art.

Another object of the present invention resides in providing an improved packaging arrangement which assures the retention of the sheets in the stack at their proper position during an entire processing operation by a processing machine.

A further object of the present invention resides in providing a packaging arrangement for stacks of sheets which can be manufactured in a simple and economical fashion.

Still another object of the present invention resides in providing a packaging arrangement for stacks of sheets which can readily be installed and removed from holding devices of the processing machine without any difficulty.

A still further object of the present invention resides in providing a packaging arrangement for stacks of sheets which permits the construction of the necessary guide and holding means of the processing machine to be fashioned in a relatively simple manner.

These and other objects, features, and advantages of the present invention will become more apparent from the following description when taken in connection with the accompanying drawings which show, for the purposes of illustration only, two embodiments of a packaging arrangement in accordance with the present invention, and wherein.

Figure 2:
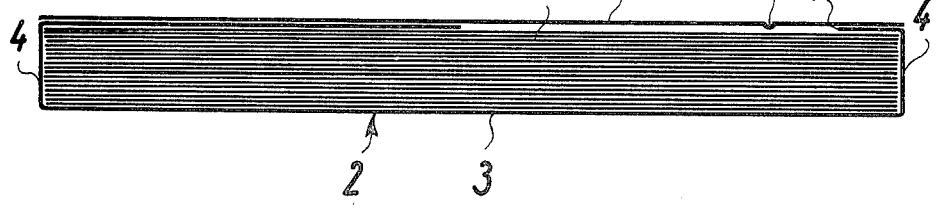
FIG. 2 is a longitudinal sectional view taken along line II—II of FIG. 1 with the packaging arrangement in a closed condition.

Referring now to the drawings wherein like reference numerals are used throughout the various views to designate like parts, according to these figures, a transportation and/or storage container generally designated by the reference numeral 2 is provided for packaging a stack coated with a predetermined number of sheets 1 of, for example, zinc oxide (ZnO), which sheets may be subsequently fed into a conventional copying machine (not shown) as a copying material. The container 2 is closed on all sides and is formed from a single cut-to-size panel or piece of relatively stiff material such as, for example, cardboard or paperboard with the size of the panel or sheet being determined by the specific size of the sheets 1 to be accommodated in the container 2.

Figure 4:
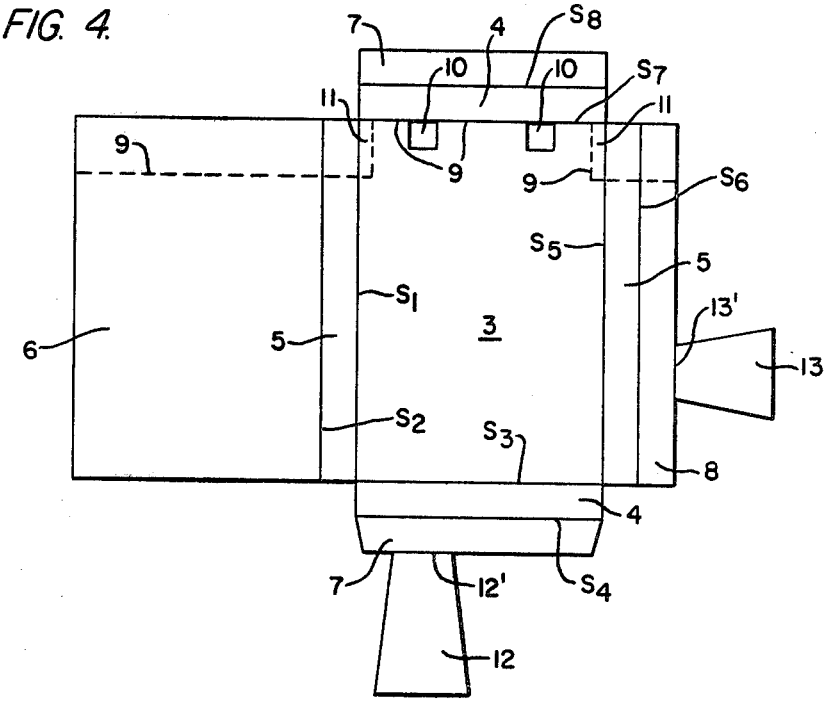
FIG. 4 is a plan view of a blank form from which the packaging arrangement of FIG. 1 can be formed.

As shown in FIG. 4, the single sized panel or piece of relatively stiff material is provided with scoring lines $S_1$–$S_8$ arranged thereon defining positions at which the panel is to be folded to form the container 2 with a bottom wall 3, two spaced end walls 4, two spaced side walls 5, and a top wall 6. The scoring lines $S_1$,$S_5$ are arranged between the bottom wall 3 and the respective side walls 5 with scoring lines $S_3$,$S_7$ being arranged between the bottom wall 3 and respective end walls 4. A scoring line $S_2$ is arranged between one of the side walls 5 and a top wall or cover 6.

Preferably, a stack of sheets 1 is placed on the sized panel at the bottom wall 3 and thereafter the end walls 4 and side walls 5 are folded over, for example, by conventional mechanical means so that the walls 4, 5 are in an upright position, whereupon the top wall or cover 6 is then folded over the stack of sheets 1, whereby the container 2 completely surrounds the sheets 1.

The upper ends of the two end walls 4 and at least one of the side walls 5 are provided with tabs 7, 8 which are angularly bent toward the inside or center of the container 2 with the tabs 7, 8 forming a support surface for receiving the top wall or cover 6 of the container 2. To facilitate the bending of the tabs 7, 8, scoring lines $S_4$,$S_6$, $S_8$ may be provided at the upper ends of end walls 4 and the at least one side wall 5 between the respective walls 4, 5 and associated tabs 7, 8. As readily apparent, prior to a folding of the top wall or cover 6, the tabs 7, 8 are bent toward the inside or center of the container so as to form the support surface for the top wall or cover 6. A suitable adhesive such as, for example, glue or the like, can be arranged between the top wall 6 of the container 2 and tabs 7, 8, either along the entire surface of the tabs 7, 8 or at spaced positions therealong.

A predetermined separating line 9 formed, for example, as perforations or the like is arranged at the top wall member 6 of the container 2 so as to permit a breaking open of the container 2 in such a manner that, after the container has been opened, it still maintains a pocket-like shape so that it can readily be inserted in the manner of a cassette into an appropriate guide means of, for example, a copying machine or the like, adapted to receive the container whereby the opened container functions to retain the shape of the stack which function has previously been imparted to the guide means of the processing machine. Consequently, the guide means for receiving the container can be simplified in construction thereby reducing the initial cost and maintenance of the processing machine.

Upon breaking open the container 2, the separated portion resulting includes an end wall 4, a marginal strip of the top wall 6 of the container which extends from the separated end wall 4 to the separating line 9, two tongues 10 which extend from the end wall 4 into the bottom wall 3, a portion of the side walls 5 extending from the separated end wall 4 to the separating line 9, and a marginal strip 11 arranged at the bottom wall 3.

Figure 3:
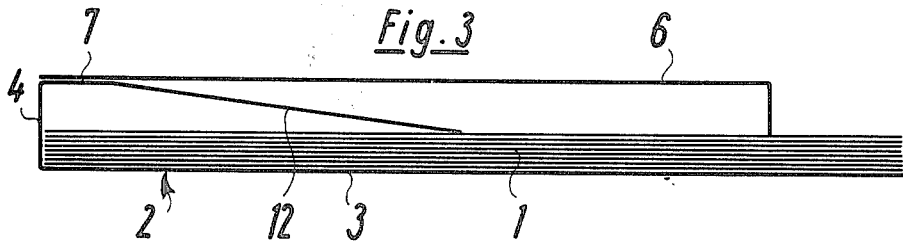
FIG. 3 is a longitudinal section according to FIG. 2 through a packaging arrangement which has been opened and is approximately half-empty.

As shown most clearly in FIG. 3, the removal of the separated portion of the container 2, which can be accomplished by simply tearing the same off, results in the stack of sheets 1 being uncovered to such an extent that the sheets 1 can be gripped or seized by a separator or take-off device of, for example, a copying machine. Since the lateral edge of the stack of sheets is completely uncovered in the opened zone of the container, the sheets can be gripped and held by means of corner separators or the like with the cut-outs resulting from the removal of the tongues 10 permitting access for holding devices or the like to the underside of the stack of sheets 1 to thereby exert a certain clamping force directly on the stack of sheets so that the separation of the sheets is, in many cases, greatly facilitated.

Since the container 2, utilized in the manner of a cassette insertible into a processing device so that the opened end of the container faces separating or take-off means of the processing device, has a sufficient rigidity by virtue of the constructional material of the container, it is sufficient to support the container 2, for example, only up to the center thereof so that the necessary guide and holding means of, for example, a copying machine, can be constructed in a relatively simple manner.

Flaps 12, 13 are provided and extend from the tab 7 of the unremoved wall 4 and tab 8 of the side wall 5, respectively. Scoring lines 12',15' or similar notches are provided between the tabs 7, 8 and the associated flaps 12, 13 so that the flaps 12, 13 contact the stack of sheets 1 from above with a resilient force.

Figure 1:
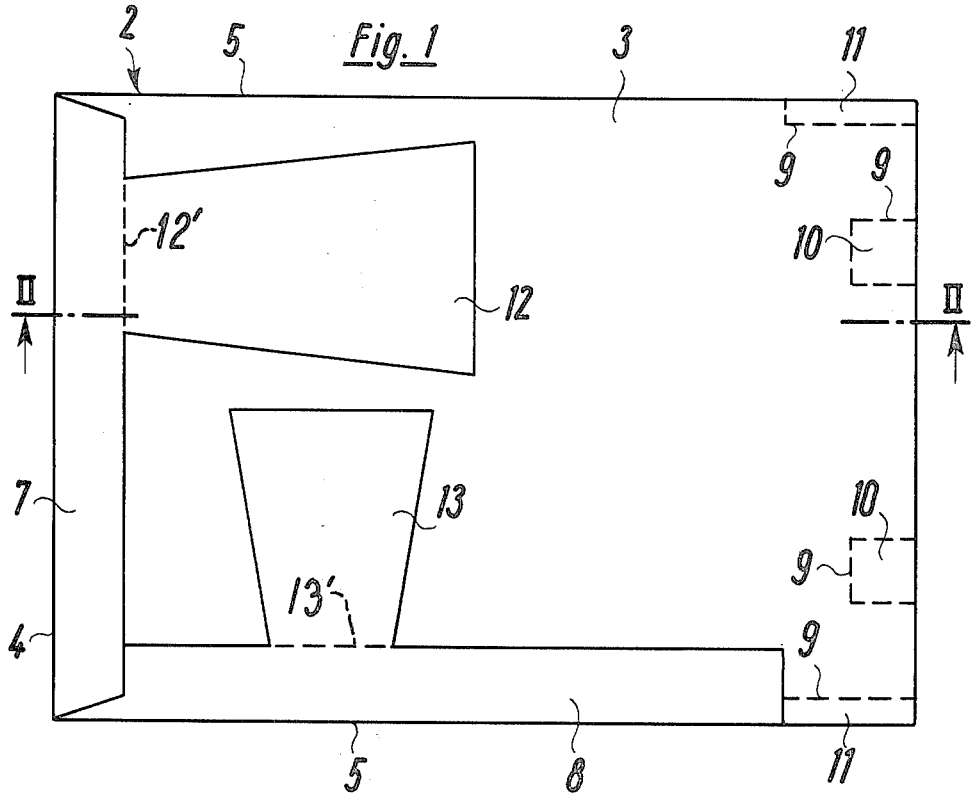
FIG. 1 is a top view of a first embodiment of a packaging arrangement according to the present invention in an opened condition with the top or cover thereof being removed.

As shown most clearly in FIG. 1, the flaps 12, 13 have a trapezoidal surface in a top view with the narrow sides of the flaps 12, 13 being arranged at the tabs 7, 8 respectively. The flaps 12, 13 ensure the maintenance of the sheets 1 of the stack in a proper position with a certain force even when the container 2 is extensively empty, as shown in FIG. 3, so that the sheets 1 cannot be uncontrollably deformed and, in particular, assume a curled or curved shape.

Moreover, the flaps 12, 13 serve as a safety means or barrier against the reinsertion of the sheets once they have been removed from the container 2. This barrier results from the fact that the flap 13, extending essentially transversely of the opened end of the container, will prevent any reinsertion of the sheet. Provision of such a safety means or barrier is advantageous in that errors which could, for example, result from the insertion of the sheet or sheets into the container in the wrong way are avoided.

Figure 7:
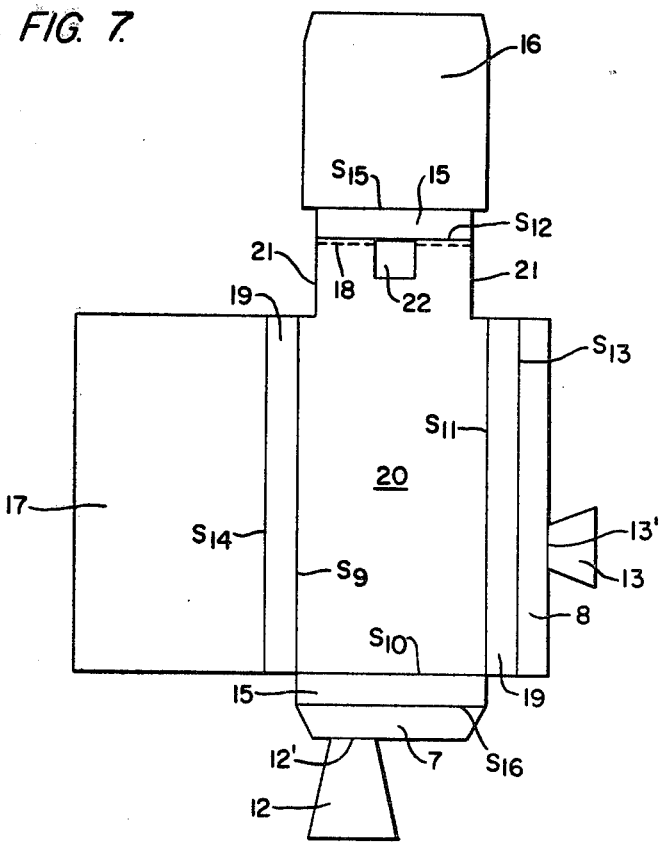
FIG. 7 is a plan view of a blank form from which the packaging arrangement of FIG. 5 can be formed.
Figure 5:
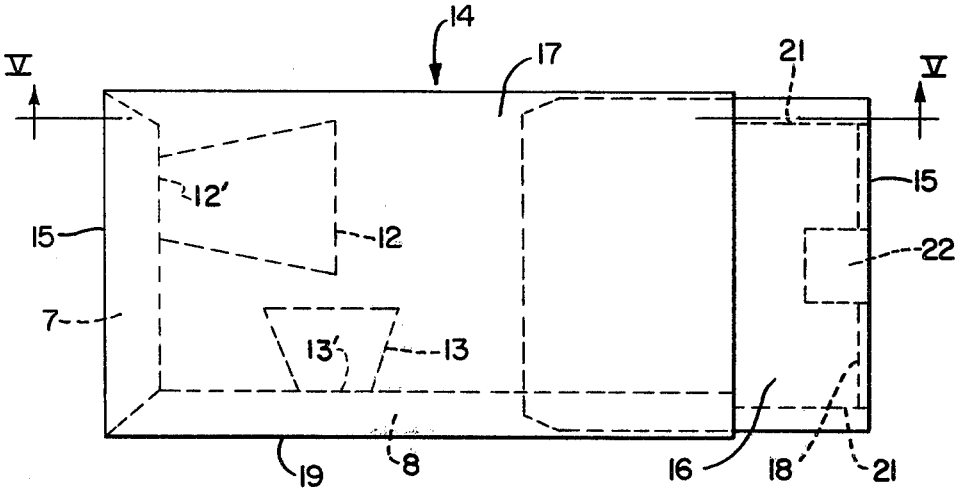
FIG. 5 is a partial top view of a second embodiment of a packaging arrangement in accordance with the present invention in a closed position.
Figure 6:
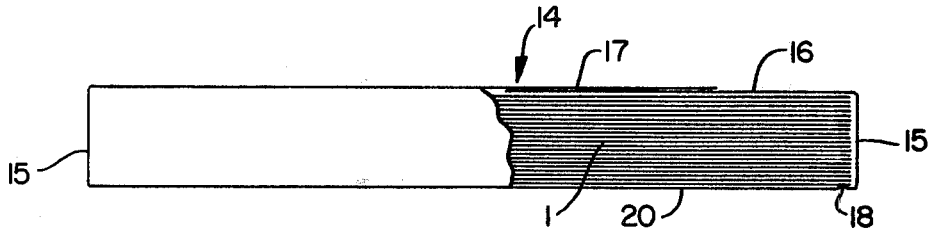
FIG. 6 is a partial longitudinal sectional view taken along the line V—V of FIG. 4.

As shown in FIGS. 5 and 6, a container designated 14 is provided for packaging a stack of a predetermined number of sheets 1 with the container being closed on all sides and formed from a single cut-to-size panel or piece of relatively stiff material. As with the embodiment of FIGS. 1–3, as shown in FIG. 7, the panel is provided with scoring lines $S_9$–$S_{16}$ defining positions at which the panel is to be folded to form the container 14 with a bottom wall 20, two spaced end walls 15, two spaced side walls 19 and a top wall 17. The scoring lines $S_{10}$, $S_{12}$ are arranged between the bottom wall 20 and the respective walls 15 with the scoring lines $S_9$, $S_{11}$ being arranged between the bottom wall 20 and respective side walls 19. The scoring lines $S_{14}$ is arranged between one of the side walls 19 and a top wall or cover 17. A fishplate 16 is provided on the end wall 15 of the container 4 on the side thereof which is to be introduced into the copying machine. To facilitate a bending of the fishplate 16, a scoring line $S_{15}$ is provided between the end wall 15 and the fishplate 16.

As with the packaging arrangement of FIGS. 1–3, in the arrangement of FIGS. 5–7, a stack of sheets 1 is placed on the sized panel at the bottom wall 20 and thereafter the end walls 15 and side walls 19 are folded over by conventional mechanical means so that the end walls 15 and side walls 19 are in an upright position whereupon the top wall or cover is then folded over the stack of sheets and the fishplate 16 is thrust in beneath a free edge of the top wall so as to close the container 14.

A predetermined separating line 18, preferably a perforated line, is provided along the bottom wall 2o at a distance from the front edge of the stack of sheets 1. Additionally, notches or cut-outs 21, 22 are initially provided in the sized panel so that no container material is present at the side walls 19 and bottom wall 20 in the region of the notches 21, 22. As shown most clearly in FIG. 4, the notches 21 provided in the side walls 19 extend from the end wall 15 over a distance corresponding to the space between the end wall 15 and a free edge of the top wall 17.

To open the container 14, the fishplate 16 is pulled out and separated from the remaining portion of the container along the separation line 18 with the separation running transverse to the container 14. The removal of the separated portion, namely, the fishplate 16, end wall 15and narrow strip of the bottom wall 20 uncovers the stack of sheets 1 so as to permit the sheets 1 to be gripped or sized by a separator or take-off device of, for example, a copying machine. The presence of the notches 21, 22 permits access for holding devices or the like to the sides and underside of the stack of sheets 1 to exert a direct clamping force on the stack of sheets 1 to facilitate sheet separation.

As shown most clearly in FIGS. 5 and 7, the container 14 may be provided with tabs 7, 8 and flaps 12, 13 which function in the manner more fully described hereinabove in connection with FIGS. 1–3. For this purpose scoring lines $S_{13}$, $S_{16}$ are provided between the side wall 19 and tab 8 and between the end wall 15 and tab 7 with scoring lines 12', 13' being provided between the flaps 12, 13 and the tabs 8, 7, respectively.

When utilizing the packaging arrangement of the present invention to accommodate coated sheets of material which serve as a copying material for a copying machine, provision is made that, for example, the sheets 1 of the stack are positioned so that their coated sides are arranged on top as viewed in the drawings.

While we have shown and described only two embodiments in accordance with the present invention, it is understood that the same is not limited thereto but is susceptible of numerous changes and modifications as known to a person skilled in the art, and we therefore do not wish to be limited to the details shown and described herein but intend to cover all such changes and modifications as are encompassed by the scope of the appended claims.

We claim:

1. An arrangement for packaging sheets, characterized in that the arrangement includes a container for accommodating a predetermined number of sheets to form a stack of sheets, said container surrounds and is adapted to the contour of the stack of sheets and includes a top wall member, bottom wall member, a pair of spaced side wall members, and a pair of spaced end wall members, said top wall member terminating in a free edge spaced from one of said end wall members, a fishplate means is arranged on one of said end wall members which extends over the space between said one of said end wall members and said free edge, said fishplate means being insertable beneath said free edge of said top wall member so as to close the container, at least one notch is provided in each side wall member for uncovering lateral side portions of a stack of sheets, each of said notches extends from one of said end wall members over a distance at least corresponding to the space between said one of said end wall members and said free edges, at least one further notch is provided in said bottom wall member for uncovering a portion of an underside of a stack of sheets, and in that separating means are arranged on and extend transversely of the bottom wall member at a predetermined distance from said last-mentioned end wall member such that, upon a separation of the container along the separating means, said fishplate means, said last-mentioned end wall member, and a strip of said bottom wall member are removed from the container such that a portion of an upper side of a stack of sheets, lateral side portions of a stack of sheets adjacent the at least one notch provided in each of said side wall members, an underside of a stack of sheets adjacent the at least one further notch in said bottom wall member, and the forward edges of a stack of paper are exposed.

2. An arrangement according to claim 1, characterized in that the container includes a sized piece of relatively stiff material, and in that said separating means includes at least one separating line arranged on said piece of material.

3. An arrangement according to claim 2, characterized in that said stiff material is cardboard.

4. An arrangement according to claim 1, characterized in that a stack of sheets is arranged in the container, said stack of sheets being composed of a plurality of coated copying sheets for a copying machine.

5. An arrangement according to claim 1, wherein said separating means is a perforated separating line provided in said bottom wall member.

6. An arrangement according to claim 5, characterized in that a stack of sheets is arranged in the container, said stack of sheets being composed of a plurality of coated copying sheets for a copying machine.

7. An arrangement according to claim 6, characterized in that flap means are arranged on at least one of the other of said end wall members and one of said side wall members for maintaining the stack of sheets in a proper position, and in that means are provided for resiliently urging said flap means into engagement with the stack of sheets.

8. An arrangement according to claim 7, characterized in that said flap means have a trapezoidal configuration as viewed from the top of the container, and in that a narrow side of said flap means adjoins at least one of the other end wall member and said side wall member.

9. An arrangement according to claim 1, characterized in that means are arranged at said container for preventing a reinsertion of a sheet removed therefrom.

10. An arrangement according to claim 1, characterized in that flap means are arranged in the container for maintaining a stack of sheets accommodated therein in a proper position, and in that means are provided for resiliently urging said flap means into engagement with an accommodated stack of sheets.

* * * * *